US009159265B2

(12) United States Patent
Han

(10) Patent No.: US 9,159,265 B2
(45) Date of Patent: Oct. 13, 2015

(54) PIXEL, DISPLAY DEVICE INCLUDING THE SAME, AND DRIVING METHOD THEREOF

(71) Applicant: Samsung Display Co., Ltd., Yongin, Gyeonggi-Do (KR)

(72) Inventor: Sang-Myeon Han, Yongin (KR)

(73) Assignee: Samsung Display Co., Ltd., Giheung-Gu, Yongin-si, Gyeonggi-Do (KR)

( * ) Notice: Subject to any disclaimer, the term of this patent is extended or adjusted under 35 U.S.C. 154(b) by 213 days.

(21) Appl. No.: 13/782,045

(22) Filed: Mar. 1, 2013

(65) Prior Publication Data

US 2014/0139502 A1 May 22, 2014

(30) Foreign Application Priority Data

Nov. 20, 2012 (KR) ..... 10-2012-0131871

(51) Int. Cl.

| | |
|---|---|
| ***G09G 3/32*** | (2006.01) |
| *G09G 5/00* | (2006.01) |
| *G09G 3/30* | (2006.01) |
| *G09G 3/00* | (2006.01) |

(52) U.S. Cl.

CPC ..... *G09G 3/3233* (2013.01); *G09G 3/003* (2013.01); *G09G 3/30* (2013.01); *G09G 5/00* (2013.01); *G09G 2300/043* (2013.01); *G09G 2300/0852* (2013.01); *G09G 2300/0861* (2013.01); *G09G 2300/0876* (2013.01); *G09G 2320/045* (2013.01)

(58) Field of Classification Search

CPC ..... G09G 3/3233; G09G 2300/0819; G09G 2300/0861; G09G 2300/0852; G09G 2300/0842; G09G 2320/043; G09G 3/3208; G09G 2310/045; G09G 2320/0233; G09G 3/3258

See application file for complete search history.

(56) References Cited

U.S. PATENT DOCUMENTS

| | | | | |
|---|---|---|---|---|
| 2006/0267885 | A1* | 11/2006 | Kwak et al. | 345/76 |
| 2011/0084947 | A1* | 4/2011 | Chung et al. | 345/211 |
| 2012/0139901 | A1* | 6/2012 | Hwang | 345/419 |
| 2012/0146999 | A1* | 6/2012 | Hwang | 345/419 |
| 2012/0147060 | A1* | 6/2012 | Jeong | 345/690 |

FOREIGN PATENT DOCUMENTS

| | | | |
|---|---|---|---|
| KR | 10-2012-0062499 | A | 6/2012 |
| KR | 10-2012-0065139 | A | 6/2012 |
| KR | 10-2012-0073534 | A | 7/2012 |

* cited by examiner

*Primary Examiner* — Kent Chang
*Assistant Examiner* — Sujit Shah
(74) *Attorney, Agent, or Firm* — Robert E. Bushnell, Esq.

(57) ABSTRACT

A display device includes a plurality of pixels including a first capacitor connected between a data line and a first node, a switching transistor connecting the first node and a second node, a first light emitting transistor transmitting a first power source voltage to the second node, a driving transistor having one electrode connected to the second node and controlling a driving current flowing to an organic light emitting diode (OLED), and a reference voltage transistor transmitting a reference voltage to the first node, wherein, when the first power source voltage is applied to the second node through the first light emitting transistor such that a light emitting step in which the OLED emits light is simultaneously performed in a plurality of pixels.

34 Claims, 13 Drawing Sheets

PIXEL, DISPLAY DEVICE INCLUDING THE SAME, AND DRIVING METHOD THEREOF

CLAIM PRIORITY

This application makes reference to, incorporates the same herein, and claims all benefits accruing under 35 U.S.C. §119 from an application earlier filed in the Korean Intellectual Property Office on 20 Nov. 2012 and there duly assigned Serial No. 10-2012-0131871.

BACKGROUND OF THE INVENTION

1. Field of the Invention

The present invention relates to a display device and a driving method thereof. More particularly, the present invention relates to a pixel including an organic light emitting diode (OLED), an active matrix display device including the same, and a driving method thereof.

2. Description of the Related Art

An organic light emitting diode (OLED) display uses an organic light emitting diode (OLED) having luminance that is controlled by a current or a voltage. The organic light emitting diode (OLED) includes an anode and a cathode forming an electric field, and an organic light emitting material emitting light by the electric field.

In general, the organic light emitting diode (OLED) display is classified into a passive matrix type of OLED (PMOLED) and an active matrix type of OLED (AMOLED) according to a driving method of the organic light emitting diode (OLED).

Among them, in views of resolution, contrast, and operation speed, the AMOLED that is selectively turned on for every unit pixel is mainly used. One frame of the active matrix type display device includes a scan period for image data programming and a light emission period for light emission according to the programmed image data.

Recently, the display panel has been increased in size with increasing resolution. As the display panel is increased in size and resolution is increased, time for image data programming is increased and driving of the display device becomes difficult.

Such problems become more sever in displaying of a stereoscopic image. When the display device displays a stereoscopic image according to the national television system committee (NTSC) type, the display device should alternately display 60 frames of a left-eye image and 60 frames of a right-eye image in one second. Thus, the display device displaying a stereoscopic image requires two or more times the driving frequency than that of a display device displaying a general image.

Accordingly, a pixel having a structure that is appropriate for enlargement of a display panel, high-resolution, and displaying a stereoscopic image and can assure a sufficient aperture ratio is needed.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a pixel having a structure that is appropriate for enlargement of a high-resolution display panel, and displaying a stereoscopic image, and that can assure a sufficient aperture ratio, a display device including the pixel, and a driving method of the display device.

A display device according to an exemplary embodiment of the present invention includes a plurality of pixels including a first capacitor connected between a data line and a first node, a switching transistor connecting the first node and a second node, a first light emitting transistor transmitting a first power source voltage to the second node, a driving transistor having one electrode connected to the second node and controlling a driving current flowing to an organic light emitting diode (OLED), and a reference voltage transistor transmitting a reference voltage to the first node, wherein, when the first power source voltage is applied to the second node through the first light emitting transistor such that a light emitting step in which the organic light emitting diode (OLED) emits light is simultaneously performed in a plurality of pixels, the switching transistor is turned off and the reference voltage transistor is turned on such that the reference voltage is transmitted to the first node, and a data voltage corresponding to a scan signal of a gate-on voltage respectively corresponding to a plurality of pixels is stored to the first capacitor.

The reference voltage transistor may be turned on by a scan signal of the gate-on voltage such that the reference voltage is transmitted to the first node.

A second switching transistor that may be turned on by the scan signal of the gate-on voltage to transmit the data voltage to the first capacitor may be further included.

The plurality of pixels may further include a compensation transistor connecting the gate electrode and the other electrode of the driving transistor.

The plurality of pixels may further include an initialization transistor connected to the gate electrode of the driving transistor.

The plurality of pixels may further include a second light emitting transistor connected to the other electrode of the driving transistor and an anode of the organic light emitting diode (OLED).

An initialization transistor may include a gate electrode applied with an initialization signal, one electrode connected to the data line, and the other electrode connected to the gate electrode of the driving transistor.

When the initialization signal of the gate-on voltage is applied to the gate electrode of the initialization transistor, the initialization voltage may be applied to the data line.

The plurality of pixels may further include a second initialization transistor including a gate electrode applied with the initialization signal, one electrode connected to the first power source voltage, and the other electrode connected to the second node.

The initialization transistor may include a gate electrode applied with the initialization signal, one electrode applied with the initialization voltage, and the other electrode connected to the gate electrode of the driving transistor.

A second initialization transistor including a gate electrode applied with the initialization signal, one electrode connected to the first power source voltage, and the other electrode connected to the second node may be further included.

When a compensation control signal of the gate-on voltage is applied to the gate electrode of the compensation transistor, the data line may be applied with a sustain voltage and the compensation control signal of the gate-on voltage is applied to the gate electrode of the switching transistor gate electrode such that the data voltage that was stored to the first capacitor is transmitted to the second node with reference to the sustain voltage.

The data voltage that was stored to the first capacitor may be the data voltage that is applied in a frame previous to a current frame.

The plurality of pixels may further include a second capacitor connected between the gate electrode of the driving transistor and the first power source voltage to store a voltage reflecting the data voltage of the previous frame.

A method of driving a display device respectively including a plurality of pixels including a first capacitor connected between a data line and a first node, a switching transistor connecting the first node and a second node, a first light emitting transistor transmitting a first power source voltage to the second node, a driving transistor having one electrode connected to the second node and controlling a driving current flowing to the organic light emitting diode (OLED), and a reference voltage transistor transmitting a reference voltage to the first node according to another exemplary embodiment of the present invention includes: a scan step in which the data voltage transmitted through the data line is stored to the first capacitor when the switching transistor is turned off and the scan signal of the gate-on voltage is transmitted to the reference voltage transistor; and a light emitting step in which the first power source voltage is applied to the second node through the first light emitting transistor such that an organic light emitting diode (OLED) emits light, wherein each light emitting step of the plurality of pixels is a simultaneous period, and the scan step and the light emitting step are temporally overlapped with each other.

The scan step may include a step in which the scan signal of the gate-on voltage is applied to the gate electrode of the second switching transistor connecting the data line and the first capacitor to transmit the data voltage to the first capacitor.

The light emitting step may include a step in which the first light emitting transistor transmitting the first power source voltage to one electrode of the driving transistor is turned on, and a step in which the second light emitting transistor connected between the other electrode of the driving transistor and an anode of the organic light emitting diode (OLED) is turned on.

An initialization step in which an initialization signal of the gate-on voltage is applied to the gate electrode of the initialization transistor connected to the gate electrode of the driving transistor to transmit the initialization voltage to the gate electrode of the driving transistor may be further included.

The initialization step may include a step in which the initialization signal of the gate-on voltage is applied to the gate electrode of the initialization transistor, wherein the initialization transistor includes one electrode connected to the data line and the other electrode connected to the gate electrode of the driving transistor.

The initialization step may include a step in which the second initialization transistor including a gate electrode applied with the initialization signal, one electrode connected to the first power source voltage, and the other electrode connected to the second node is turned on.

The initialization step may include a step in which an initialization signal of a gate-on voltage is applied to the gate electrode of the initialization transistor, wherein the initialization transistor includes one electrode applied with the initialization voltage and the other electrode connected to the gate electrode of the driving transistor.

The initialization step may include a step in which the second initialization transistor including a gate electrode applied with the initialization signal, one electrode connected to the first power source voltage, and the other electrode connected to the second node is turned on.

A compensation step in which a compensation control signal of the gate-on voltage is applied to the gate electrode of the compensation transistor connecting the gate electrode and the other electrode of the driving transistor to compensate the threshold voltage of the driving transistor may be further included.

The compensation step may include a step in which a sustain voltage is applied to the data line and the compensation control signal of the gate-on voltage is applied to the gate electrode of the switching transistor to transmit the data voltage stored to the first capacitor to the second node with reference of the sustain voltage when the compensation control signal of the gate-on voltage is applied to the gate electrode of the compensation transistor.

The data voltage stored to the first capacitor may be a data voltage applied in a frame previous to the current frame.

The compensation step may include a step in which the compensation transistor is turned on, and a voltage reflecting the threshold voltage of the driving transistor and the data voltage of the previous frame is stored to the second capacitor connected to the gate electrode of the driving transistor and the first power source voltage.

A pixel according to another exemplary embodiment of the present invention includes: a first capacitor including one electrode applied with a data voltage and the other electrode connected to a first node; a reference voltage transistor including a gate electrode applied with a scan signal, one electrode connected to a reference voltage, and the other electrode connected to the first node; a first switching transistor including a gate electrode applied with a compensation control signal, one electrode connected to the first node, and the other electrode connected to a second node; a first light emitting transistor including a gate electrode applied with a light emitting signal, one electrode connected to a first power source voltage, and the other electrode connected to the second node; a driving transistor including a gate electrode connected to a third node, one electrode connected to the second node, and the other electrode connected to a fourth node; a compensation transistor including a gate electrode applied with the compensation control signal, one electrode connected to the third node, and the other electrode connected to the fourth node; and a second capacitor including one electrode connected to the third node and the other electrode connected to the first power source voltage.

A second switching transistor including a gate electrode applied with the scan signal, one electrode connected to the data line, and the other electrode connected to one electrode of the first capacitor may be further included.

A second light emitting transistor including a gate electrode applied with the light emitting signal, one electrode connected to the fourth node, and the other electrode connected to the anode of an organic light emitting diode (OLED) may be further included.

An initialization transistor transmitting an initialization voltage to the third node according to the initialization signal may be further included.

The initialization transistor may include a gate electrode applied with the initialization signal, one electrode connected to the data line, and the other electrode connected to the third node.

A second initialization transistor including a gate electrode applied with the initialization signal, one electrode connected to the first power source voltage, and the other electrode connected to the second node may be further included.

The initialization transistor may include a gate electrode applied with the initialization signal, one electrode connected to the initialization voltage, and the other electrode connected to the third node.

A second initialization transistor including a gate electrode applied with the initialization signal, one electrode connected to the first power source voltage, and the other electrode connected to the second node may be further included.

Accordingly, a pixel having a structure that stably realizes enlargement of a display panel, high-resolution, and display of a stereoscopic image and the can improve display quality of a display device is provided.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
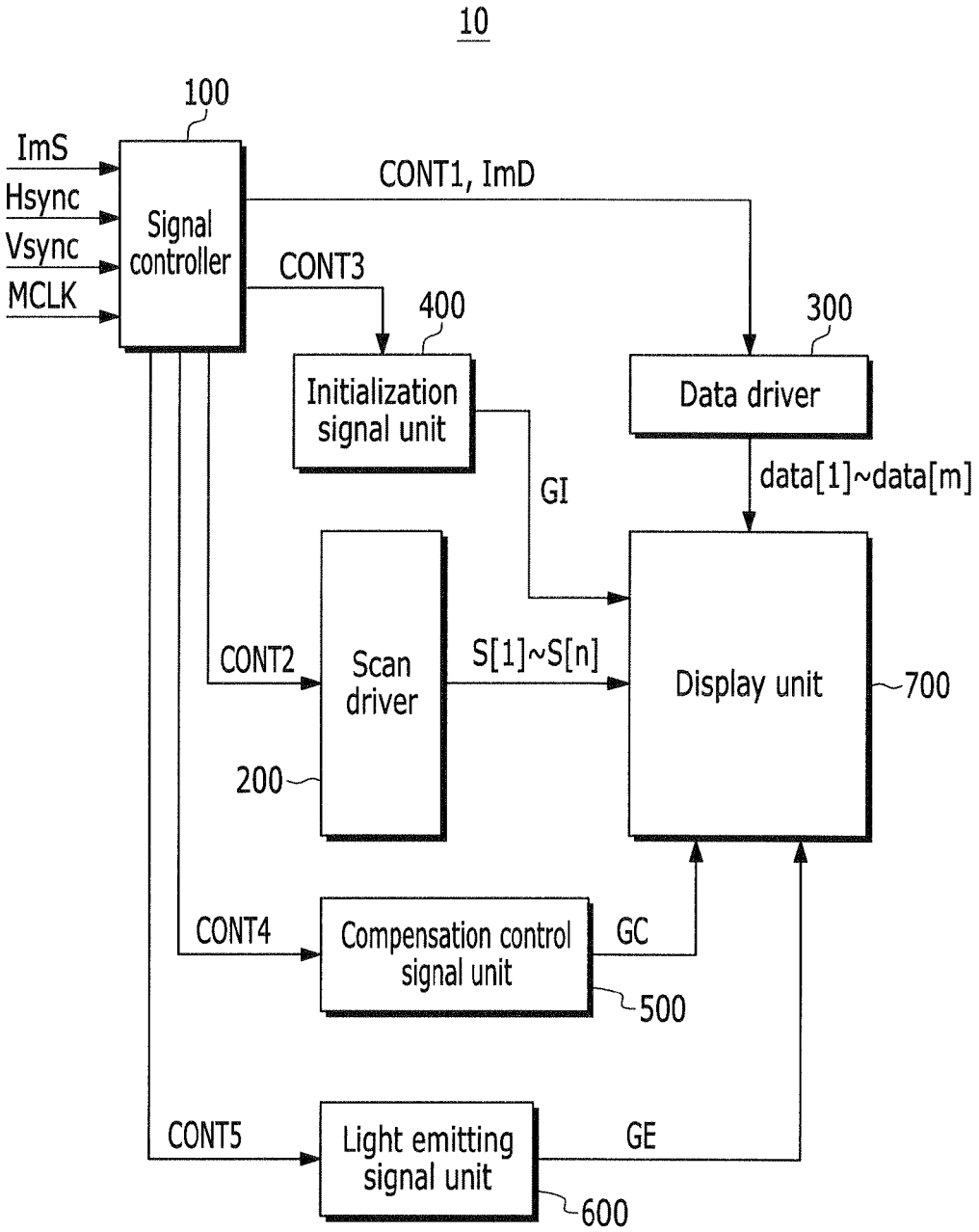
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in exemplary embodiments, like reference numerals designate like elements having the same configuration, a first exemplary embodiment is representatively described, and in other exemplary embodiments, only a configuration different from the first exemplary embodiment will be described.

The drawings and description are to be regarded as illustrative in nature and not restrictive.

Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the present invention.

Referring to FIG. 1, a display device 10 includes a signal controller 100, a scan driver 200, a data driver 300, an initialization signal unit 400, a compensation control signal unit 500, a light emitting signal unit 600, and a display unit 700.

The signal controller 100 receives an image signal ImS and a synchronization signal input from an external device. The input image signal ImS includes luminance information of a plurality of pixels. Luminance has a predetermined number of grays, for example, $1024=2^{10}$, $256=2^{8}$, or $64=2^{6}$. The synchronization signal includes a horizontal synchronization signal Hsync, a vertical synchronization signal Vsync, and a main clock signal MCLK.

The signal controller 100 generates first to fifth driving control signals CONT1, CONT2, CONT3, CONT4, and CONT5 and an image data signal ImD according to the image signal ImS, the horizontal synchronization signal Hsync, the vertical synchronization signal Vsync, and the main clock signal MCLK.

The signal controller 100 divides the image signal ImS per frame unit according to the vertical synchronization signal Vsync, and generates the image data signal ImD by dividing the image signal ImS per scan line unit according to the horizontal synchronization signal Hsync. The signal controller 100 transmits the image data signal ImD and the first driving control signal CONT1 to the data driver 300.

Although not shown, the display unit 700 is a display area including a plurality of pixels. Not shown in the display unit 700, a plurality of scan lines, a plurality of data lines, a plurality of initialization lines, a plurality of compensation control lines, and a plurality of light emission lines are connected to a plurality of pixels. Here, the plurality of scan lines are substantially extended in a row direction and almost parallel with each other, and the plurality of data lines are substantially extended in a column direction and almost parallel with each other. The plurality of pixels are substantially arranged in a matrix format.

The scan driver 200 is connected to the plurality of scan lines, and generates a plurality of scan signals S[1] to S[n] according to the second driving control signal CONT2. The scan driver 200 may sequentially apply scan signals S[1] to S[n] of a gate-on voltage to the plurality of scan lines.

The data driver 300 is connected to the plurality of data lines, samples and holds the image data signal ImD input according to the first driving control signal CONT1, and transmits a plurality of data signals data[1]~data[m] to the plurality of data lines. The data driver 300 applies a data signal having a predetermined voltage range to the plurality of data lines corresponding to the scan signals S[1] to S[n] of the gate-on voltage.

The initialization signal unit 400 is connected to the plurality of initialization lines, and generates an initialization signal GI according to a third driving control signal CONT3.

The compensation control signal unit 500 is connected to the plurality of compensation control lines, and generates a compensation control signal GC according to the fourth driving control signal CONT4.

The light emitting signal unit 600 is connected to the plurality of light emission lines, and generates a light emission signal GE according to the fifth driving control signal CONT5.

Figure 2:
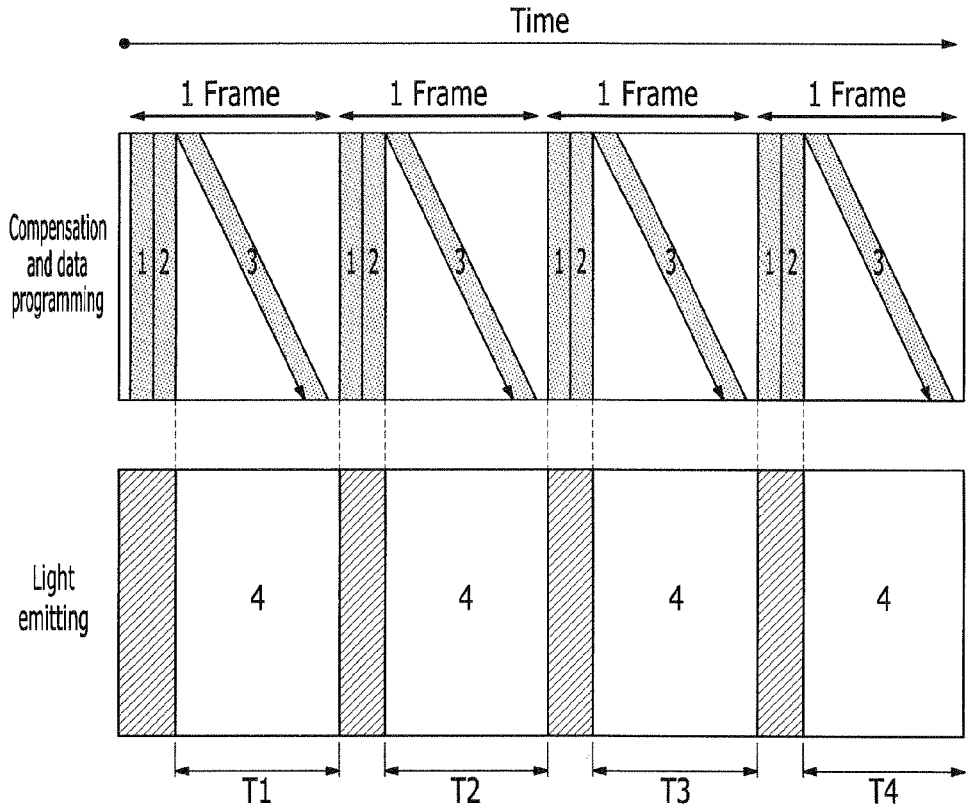
FIG. 2 is a view of a driving method of a display device according to an exemplary embodiment of the present invention.

FIG. 2 is a view of a driving method of a display device according to an exemplary embodiment of the present invention.

Referring to FIG. 2, one frame period during which a single image is displayed in the display unit 700 includes an initialization period 1 for initializing a driving voltage of an organic light emitting diode of each pixel, a compensation period 2 for compensating a threshold voltage of a driving transistor of each pixel, a scan period 3 for programming data to the respective pixels, and a light emission period 4 for light emission of the plurality of pixels corresponding to the programmed data. The scan period 3 and the light emission period 4 are temporally overlapped.

During the light emitting period 4 of the current frame, the pixel emits the light according to the data written during the scan period 3 of the previous frame. Then, the pixel emits the light during the light emitting period 4 of the next frame according to the data written during the scan period 3 of the current frame.

For example, it is assumed that a period T1 includes a scan period 3 and a light emission period 4 of an N-th frame. Data programmed to the pixels during the scan period 3 of the period T1 is data of the N-th frame, and pixels emit light according to data of an (N−1)-th frame, programmed during a scan period 3 of the (N−1)-th frame during the light emission period 4 of the period T1.

A period T2 includes a scan period 3 and a light emission period 4 of the (N+1)-th frame. Data programmed to the pixels during the scan period 3 of the period T2 is data of the (N+1)-th frame, and the pixels emit light according to the data of the N-th frame, programmed during the scan period 3 of the N-th frame, that is, the period T1.

A period T3 includes a scan period 3 and a light emitting period 4 of the (N+2)-th frame. Data programmed to the pixels during the scan period 3 of the period T3 is data of the (N+2)-th frame, and the pixels emit light according to the data of the (N+1)-th frame, programmed during the scan period 3 of the (N+1)-th frame, that is, the period T2.

A period T4 includes a scan period 3 and a light emitting period 4 of the N+3-th frame. Data programmed to the pixels during the scan period 3 of the period T4 is data of the (N+3)-th frame, and the pixels emit light according to the data of the (N+2)-th frame, programmed during the scan period 3 of the (N+2)-th frame, that is, the period T3.

A pixel structure in which data of the present frame is programmed during the scan period 3 and light emission occurs according to data of the previous frame during a period overlapped with the scan period 3, that is, the light emission period 4, will be described with reference to FIG. 3.

Figure 3:
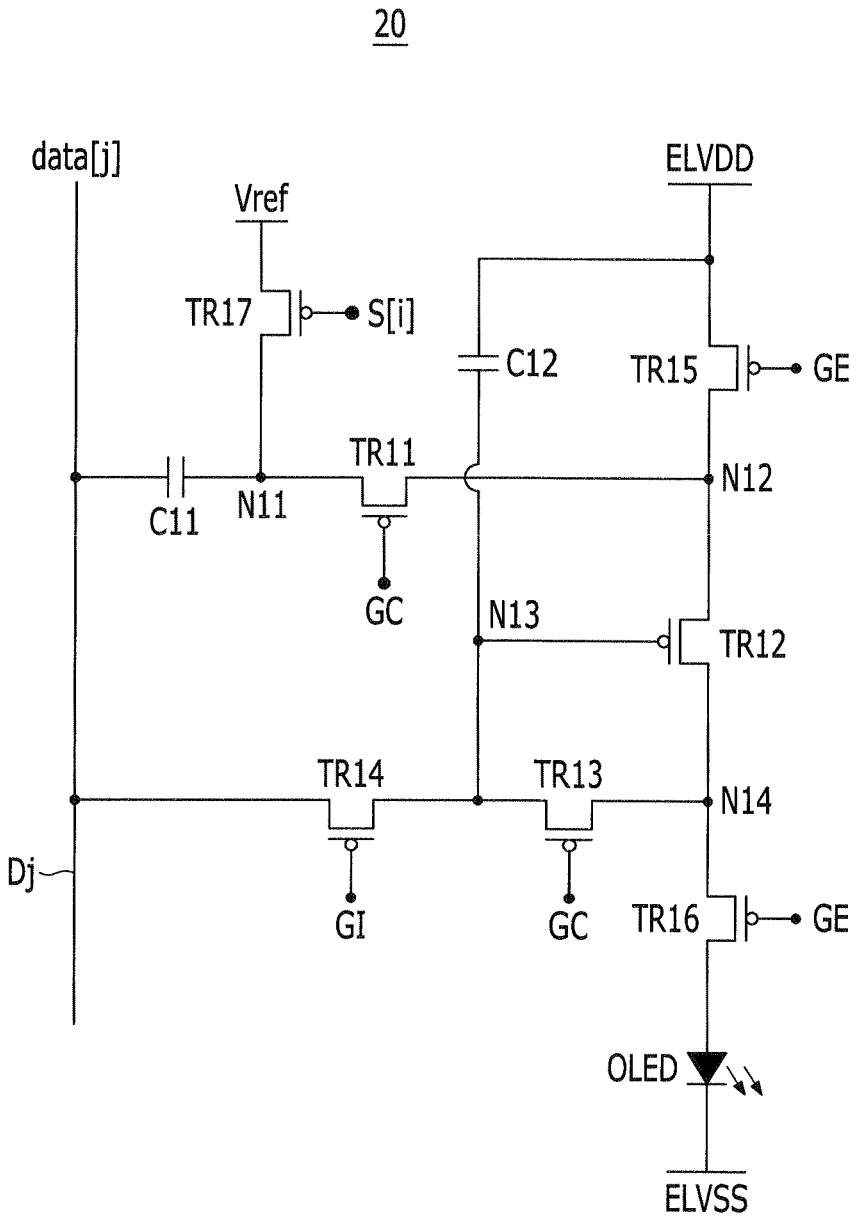
FIG. 3 is a circuit diagram of a pixel according to an exemplary embodiment of the present invention.

FIG. 3 is a circuit diagram of a pixel according to an exemplary embodiment of the present invention.

Referring to FIG. 3, a pixel 20 according to the first exemplary embodiment includes a switching transistor TR11, a driving transistor TR12, a compensation transistor TR13, an initialization transistor TR14, a first light emitting transistor TR15, a second light emitting transistor TR16, a reference voltage transistor TR17, a first capacitor C11, a second capacitor C12, and an organic light emitting diode (OLED).

The switching transistor TR11 includes a gate electrode connected to the compensation control line, one electrode connected to the first node N11, and the other electrode connected to the second node N12. The switching transistor TR11 is turned on by a compensation control signal GC of a gate-on voltage to connect the first node N11 and the second node N12.

The driving transistor TR12 includes a gate electrode connected to the third node N13, one electrode connected to the second node N12, and the other electrode connected to the fourth node N14. The driving transistor TR12 is turned-on/off by the voltage of the second node N13 to control a driving current supplied to the organic light emitting diode (OLED).

The compensation transistor TR13 includes a gate electrode connected to the compensation control line, one electrode connected to the third node N13, and the other electrode connected to the fourth node N14. The compensation transistor TR13 is turned on by the compensation control signal GC of the gate-on voltage to connect the gate electrode and the other electrode of the driving transistor TR12.

The initialization transistor TR14 includes the gate electrode connected to the initialization line, one electrode connected to the data line Dj, and the other electrode connected to the third node N13. The initialization transistor TR14 is turned on by the initialization signal GI of the gate-on voltage to transmit the initialization voltage Vinit applied to the data line Dj to the third node N13.

The first light emitting transistor TR15 includes the gate electrode connected to the light emitting line, one electrode connected to the first power source voltage ELVDD, and the other electrode connected to the second node N12. The first light emitting transistor TR15 is turned on by the light emitting signal GE of the gate-on voltage to transmit the first power source voltage ELVDD to the second node N12.

The second light emitting transistor TR16 includes the gate electrode connected to the light emitting line, one electrode connected to the fourth node N14, and the other electrode connected to the anode of the organic light emitting diode (OLED). The second light emitting transistor TR16 is turned on by the light emitting signal GE of the gate-on voltage to connect the fourth node N14 and the anode of the organic light emitting diode (OLED).

The first light emitting transistor TR15 and the second light emitting transistor TR16 are turned on by the light emitting signal GE of the gate-on voltage, and a current by the first power source voltage ELVDD is transmitted to the organic light emitting diode (OLED) through the turned on driving transistor TR12.

The reference voltage transistor TR17 includes the gate electrode connected to the scan line, one electrode connected to the reference voltage Vref, and the other electrode connected to the first node N11. The reference voltage transistor TR17 is turned on by the scan signal S[i] of the gate-on voltage to transmit the reference voltage Vref to the first node N11 ($1 \le i \le n$).

The first capacitor C11 includes one electrode connected to the data line Dj and the other electrode connected to the first node N11 ($1 \le j \le m$).

The second capacitor C12 includes one electrode connected to the third node N13 and the other electrode connected to the first power source voltage ELVDD.

The organic light emitting diode (OLED) includes the anode connected to the other electrode of the second light emitting transistor TR16 and a cathode connected to a second power source voltage ELVSS. The organic light emitting diode (OLED) emits light of one of plural primary colors.

An example of the primary colors may include three primary colors such as red, green, and blue, and a desired color may be displayed by a spatial sum or a temporal sum of the three primary colors.

The switching transistor TR11, the driving transistor TR12, the compensation transistor TR13, the initialization transistor TR14, the first light emitting transistor TR15, the second light emitting transistor TR16, and reference voltage transistor TR17 may be p-channel field effect transistors. At this time, a gate-on voltage turning on the switching transistor TR11, the driving transistor TR12, the compensation transistor TR13, the initialization transistor TR14, the first light emitting transistor TR15, the second light emitting transistor TR16, and the reference voltage transistor TR17 is a low level voltage and a gate-off voltage turning them off is a high level voltage.

Here, at least one of the switching transistor TR11, the driving transistor TR12, the compensation transistor TR13, the initialization transistor TR14, the first light emitting transistor TR15, the second light emitting transistor TR16, and the reference voltage transistor TR17 may be an n-channel field effect transistor. At this time, the gate-on voltage turning on the n-channel field effect transistor is the high level voltage and the gate off voltage turning it off is the low level voltage.

The switching transistor TR11, the driving transistor TR12, the compensation transistor TR13, the initialization transistor TR14, the first light emitting transistor TR15, the second light emitting transistor TR16, and the reference voltage transistor TR17 may be formed of one of an amorphous silicon thin film transistor (amorphous-Si TFT), a low temperature polysilicon (LTPS) thin film transistor, and an oxide thin film transistor (oxide TFT). The oxide TFT may have an activation layer of an oxide such as amorphous indium-gallium-zinc-oxide (IGZO), zinc-oxide (ZnO), titanium oxide (TiO), and the like.

The first power source voltage ELVDD is the high level voltage and the second power source voltage ELVSS is the low level voltage. The first power source voltage ELVDD and the second power source voltage ELVSS supply a driving voltage for the pixel operation.

Figure 4:
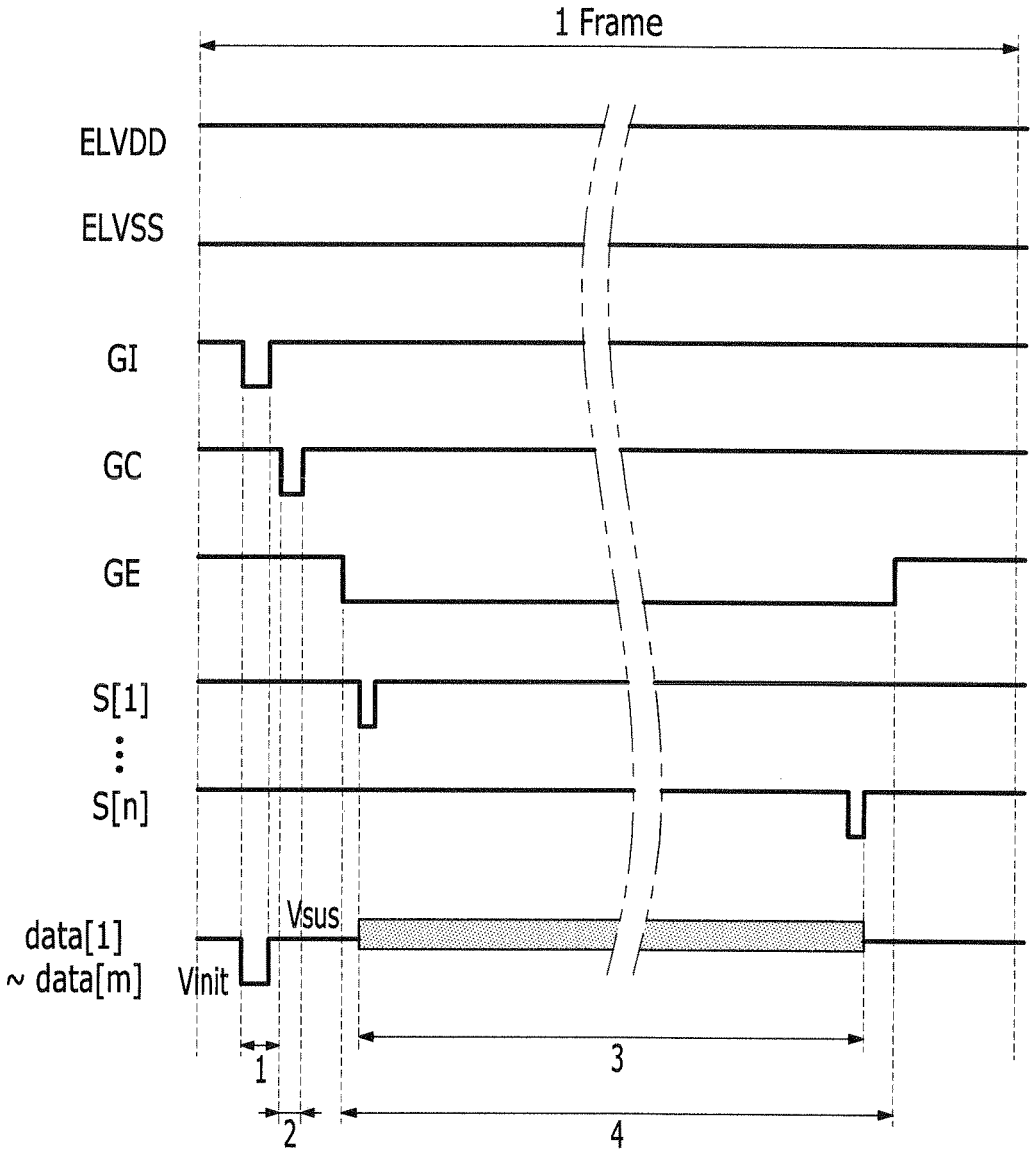
FIG. 4 is a timing diagram of a driving method of a display device according to an exemplary embodiment of the present invention.

FIG. 4 is a timing diagram of a driving method of a display device according to an exemplary embodiment of the present invention.

Referring to FIG. 3 and FIG. 4, a method for driving a display device including the pixel 20 according to the first exemplary embodiment will be described.

The first power source voltage ELVDD maintains a logic high level and the second power source voltage ELVSS maintains a logic low level during one frame. In addition, the scan signals S[1] to S[n], the initialization signal GI, the compensation control signal GC, the light emission signal GE, and the data signals data[1] to data[m] are changed according to the reset period 1, the compensation period 2, the scan period 3, and the light emission period 4.

In the initialization period 1, the initialization signal GI is applied as a logic low level voltage. In this case, the data signals data[1] to data[m] are applied as the initialization voltage Vinit. The initialization transistor TR14 is turned on and the initialization voltage Vinit is transmitted to the third node N13 through the turned on initialization transistor TR14. The initialization voltage Vinit is a low voltage for initialization of the voltage of the third node N13 to a sufficiently low voltage. The initialization voltage Vinit may be a logic low level voltage. Once the initialization operation in which the voltage of the third node N13 is initialized by the initialization voltage Vinit is completed, the initialization signal GI is converted to a logic high level voltage to turn off the initialization transistor TR14.

In the compensation period 2, the compensation control signal GC is applied as a logic low level voltage. In this case, a sustain voltage Vsus having a predetermined voltage level is applied to the data line Dj. The sustain voltage Vsus may have the same voltage level as the initialization voltage Vinit. The switching transistor TR11 and the compensation transistor TR13 are turned on. As the sustain voltage Vsus is applied to the data line Dj and the switching transistor TR11 is turned on, a voltage stored in the first capacitor C11 is applied to the second node N12 with reference to the sustain voltage Vsus. The voltage stored in the first capacitor C11 is a voltage stored in the first capacitor 11 during the scan period 3 of the frame previous to the current frame, and is Vref-data. Data implies a voltage of the data signals data[1] to data[m]. A voltage transmitted to the second node N12 becomes Vref−data+Vsus. As the compensation transistor TR13 is turned on, the driving transistor TR12 is diode-connected and a voltage to which the threshold voltage Vth of the driving transistor TR12 is reflected is applied to the third node N13.

The voltage reflecting the threshold voltage Vth of the driving transistor TR12 is stored to the second capacitor C12. A voltage Vg of the third node N13 is as shown in Equation 1.

$$Vg=(\mathrm{Chold}/(\mathrm{Chold}+Cst))(V\mathrm{ref-data}-V\mathrm{sus})+(Cst/(\mathrm{Chold}+Cst))V\mathrm{init}+(1+(Cst/(\mathrm{Chold}+Cst)))Vth \quad \text{Equation 1}$$

Here, Chold denotes capacity of the first capacitor and Cst denotes capacity of the second capacitor. That is, the voltage Vg of the third node N13 is a voltage with reflection of the threshold voltage Vth of the driving transistor TR12 and the data voltage data of the previous frame.

The voltage to which the threshold voltage Vth of the driving transistor TR12 and the data voltage data of the previous frame are reflected is applied to the third node N13 and then stored in the second capacitor C12. After that, the compensation control signal GC is converted to a logic high level voltage and thus turns off the compensation transistor TR13.

In the light emission period 4, the light emission signal GE is applied as a logic low level voltage to turn on the first light emitting transistor TR15 and the second light emitting transistor TR16.

The first power source voltage ELVDD is transmitted to the first node N11 through the turned on first light emitting transistor TR15. In addition, a current flows to the organic light emitting diode OLED through the driving transistor TR12. The driving current I_OLED flowing to the organic light emitting diode OLED is as shown in Equation 2.

$$\begin{aligned} \mathrm{I_OLED} &= k(Vgs-Vth)^2 \quad \text{Equation 2} \\ &= k[(Chold/(Chold+Cst))(Vref\text{-data-}Vsus)+ \\ &\quad (Cstl/(Chold+Cst))Vinit+(1+(Cstl/(Chold+Cst))) \\ &\quad Vth\text{-}ELVDD\text{-}Vth)]^2 \\ &= K[(Chold/(Chold+Cst))(Vref\text{-data-}Vsus)+ \\ &\quad (Cstl/(Chold+Cst))Vinit\text{-}ELVDD+ \\ &\quad (Cstl/(Chold+Cst))Vth)]^2 \end{aligned}$$

The organic light emitting diode OLED emits light with brightness that corresponds to the driving current I_OLED. In Equation 2, the threshold voltage Vth of the driving transistor TR12 is scaled, and therefore the organic light emitting diode OLED emits light with brightness corresponding to a driving current I_OLED that is insignificantly influenced by a deviation of the threshold voltage Vth of the driving transistor TR12. Particularly, as a capacity Chold of the first capacitor C11 is larger than a capacity Cst of the second capacitor C12, much more current flows to the organic light emitting diode OLED with the same IC output range of the data driver 300, and the influence due to the deviation of the threshold voltage Vth of the driving transistor T12 can be reduced.

In the scan period 3, the plurality of scan signals S[1] to S[n] are sequentially applied as logic low level voltages to turn on each reference voltage transistor TR17 of a plurality of pixels, and the plurality of data signals data[1] to data[m] are applied corresponding to the plurality of scan signals S[1] to S[n]. At this time, the compensation control signal GC is applied as the high level voltage, and the switching transistor TR11 becomes the turn-off state. As the reference voltage transistor TR17 is turned on, the reference voltage Vref is transmitted to the first node N11. If the data voltage data is transmitted to the data line Dj when the reference voltage Vref is transmitted to the first node N11, the voltage Vref-data is stored to the first capacitor C11. After the voltage Vref-data is stored to the first capacitor C11, if the reference voltage transistor TR17 is turned off, the first node N11 becomes the floating state, and although the voltage of the data line Dj is changed later, the voltage Vref-data stored to the first capacitor C11 is maintained. The Vref-data voltage stored in the first capacitor C11 is used during a light emission period 4 of the next frame.

Figure 5:
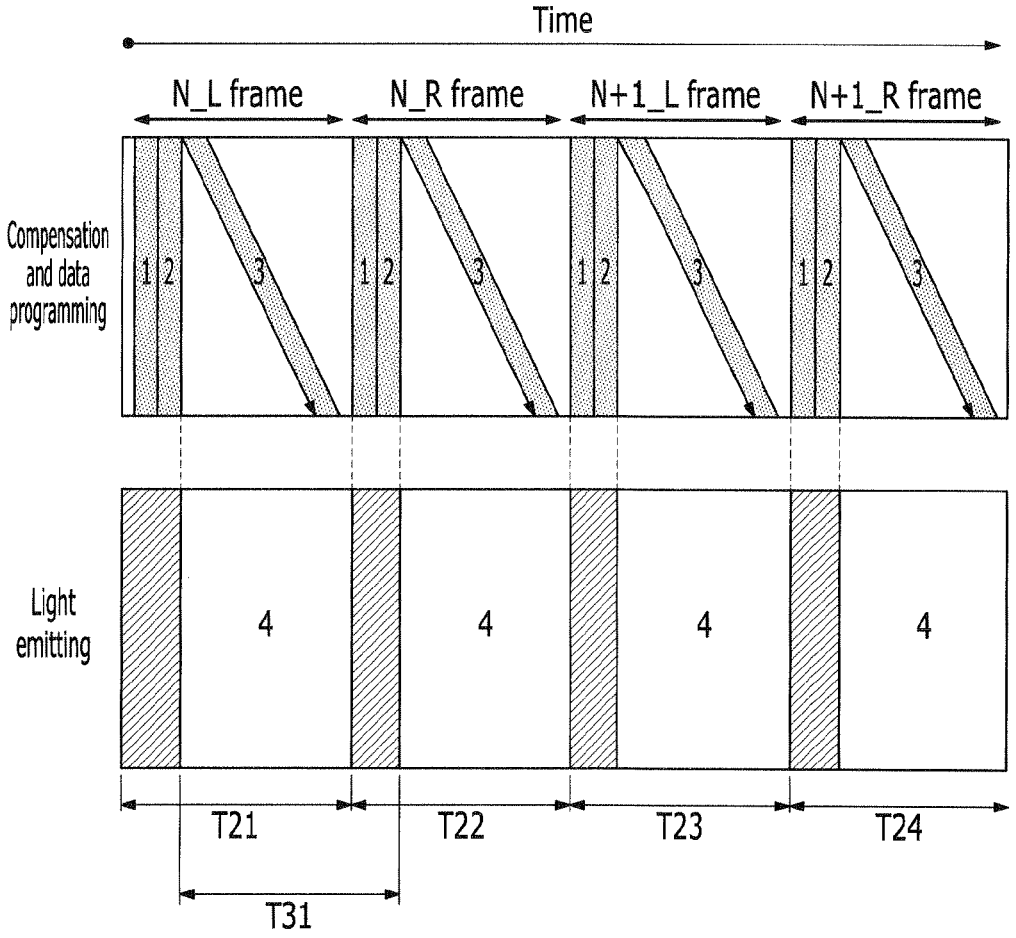
FIG. 5 is a view of a driving method of a display device according to another exemplary embodiment of the present invention.

FIG. 5 shows a driving method of a display device according to another exemplary embodiment of the present invention.

Referring to FIG. 5, a display device 10 alternately displays a left-eye image and a right-eye image according to a shutter glasses method. As shown in FIG. 5, each frame includes an initialization period 1, a compensation period 2, a scan period 3, and a light emission period 4.

A frame of which a plurality of data signals (hereinafter referred to as left-eye image data signals) representing a left-eye image are programmed to a plurality of pixels is denoted using referential numeral "L", and a frame of which a plurality of data signals (hereinafter referred to as right-eye image data signals) representing a right-eye image are programmed to the respective pixels is denoted using referential numeral "R".

In each of the initialization period 1, the compensation period 2, the scan period 3, and the light emission period 4, an initialization signal GI, a compensation control signal GC, a light emission signal GE, scan signals S[1] to S[n], and data signals data[1] to data[m] have the same waveforms of those shown in FIG. 4, and therefore no further description will be provided.

During a scan period 3 of a period T21, left-eye image data signals of an N_L frame are programmed to the plurality of pixels. During the scan period 3, a left-eye image data signal corresponding to each of the plurality of pixels is programmed. In this case, the plurality of pixels emit light according to a right-eye image data signal programmed during the scan period 3 of an N−1_R frame during a light emission period 4 of the period T21.

During a scan period 3 of a period T22, right-eye image data signals of the N_R frame are programmed to the plurality of pixels. That is, during the scan period, a right-eye image data signal corresponding to each of the plurality of pixels is programmed. In this case, the plurality of pixels emit light according to the left-eye image data signals programmed during the scan period 3 of the N_L frame during a light emission period 4 of the period T22.

During a scan period 3 of a period T23, left-eye image data signals of an N+1_L frame are programmed to the plurality of pixels. During the scan period 3, a left-eye image data signal corresponding to each of the plurality of pixels is programmed. In this case, the plurality of pixels emit light according to the right-eye image data signals programmed during the scan period 3 of the N_R frame during the light emission period 4 of the period T23.

During a scan period 3 of a period T24, right-eye image data signals of the N+1_R frame are programmed to the plurality of pixels. During the scan period 3, a right-eye image data signal corresponding to each of the plurality of pixels is programmed. In this case, the plurality of pixels emit light according to the left-eye image data signals programmed on the scan period 3 of the N+1_L frame during the light emitting period 4 of the period T24.

With such a method, the right-eye image is simultaneously light-emitted while the left-eye image is programmed, and the left-eye image is simultaneously light-emitted while the right-eye image is programmed. Then, a sufficient light emission period can be assured, thereby improving image quality of a stereoscopic image.

Since the scan period 3 and the light emission period 4 are included in the same period, a gap T31 between light emission periods 4 of the respective frames can be set without regard to the scan period. In this case, a gap optimized in liquid crystal response speed of shutter glasses may be set as the gap T31 between the light emission period 4.

In a conventional case, a scan period 3 and a light emission period 4 are not included in the same period. In this case, the light emission period 4 is provided after the scan period 3, and therefore a temporal margin for setting the light emission period 4 during one frame period is decreased.

According to the suggested driving method, the light emission period 4 may be set during a period excluding an initialization period and a compensation period during one frame period. Thus, the temporal margin for setting the light emission period 4 can be increased compared to the conventional case such that the gap T31 between the light emission periods 4 can be set in consideration of the liquid crystal response speed of the shutter glasses.

For example, the gap T31 between the light emission periods 4 may be set in consideration with a time consumed for completely opening right-eye lens (or left-eye lens) of the shutter glasses from the end of light emission of the left-eye image (or right-eye image).

Figure 6:
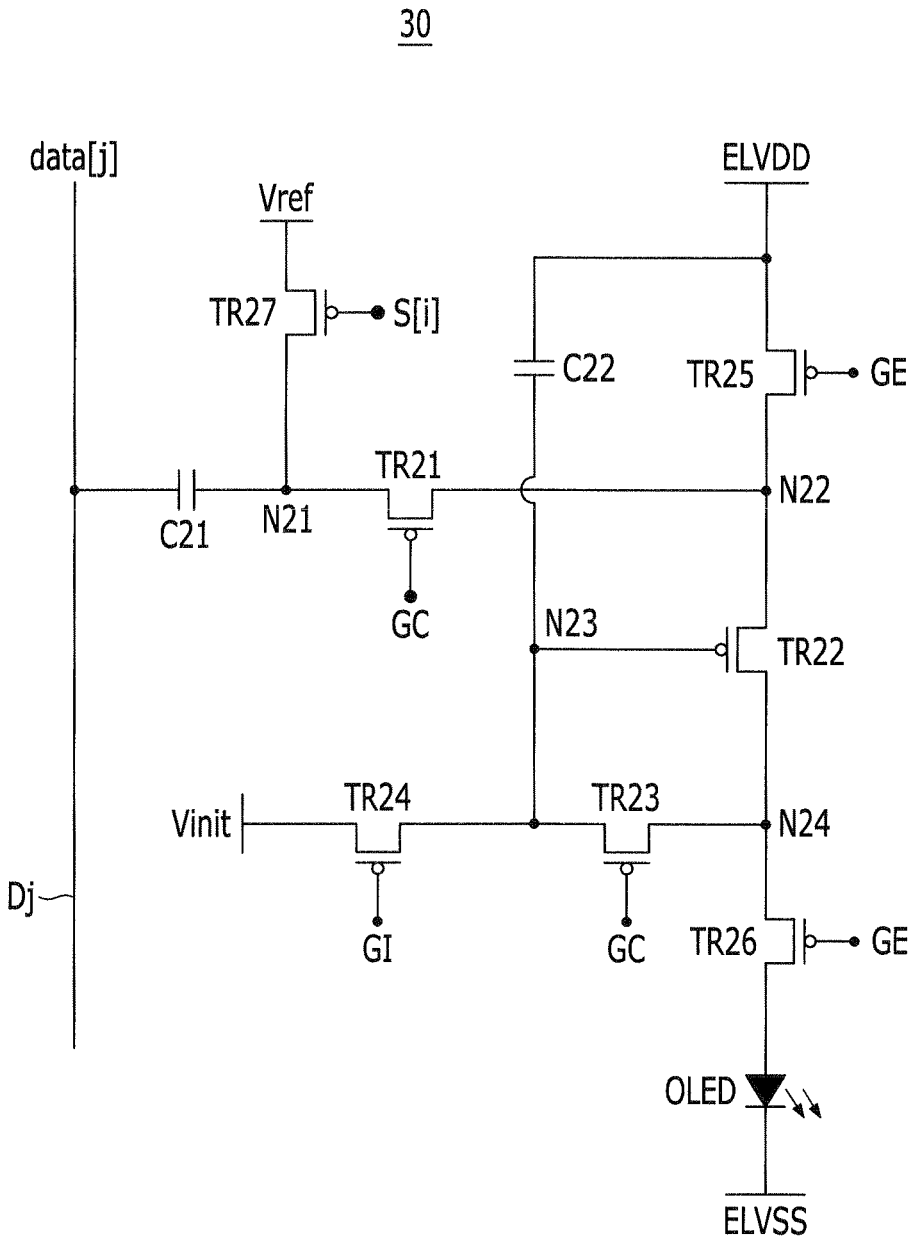
FIG. 6 is a circuit diagram of a pixel according to another exemplary embodiment of the present invention.

FIG. 6 is a circuit diagram of a pixel according to another exemplary embodiment of the present invention.

Referring to FIG. 6, a pixel 30 according to a second exemplary embodiment of the present invention includes a switching transistor TR21, a driving transistor TR22, a compensation transistor TR23, a first initialization transistor TR24, a first light emitting transistor TR25, a second light emitting transistor TR26, a second initialization transistor TR27, a first capacitor C21, a second capacitor C22, and an organic light emitting diode OLED.

Unlike the pixel 20 of the first exemplary embodiment, the pixel 30 of the second exemplary embodiment further includes the initialization transistor TR24 including the gate electrode connected to the initialization line, one electrode connected to an initialization voltage Vinit, and the other electrode connected to the third node N23. The initialization transistor TR24 is turned on by the initialization signal GI of the gate-on voltage to transmit the initialization voltage Vinit to the third node N23. That is, in the pixel 30 according to the second exemplary embodiment, the third node N23 is initialized as the initialization voltage Vinit during the initialization period 1 through the initialization voltage Vinit that is separately provided, not the data line Dj.

The initialization voltage Vinit and the reference voltage Vref may use the same wire. That is, the initialization voltage Vinit and the reference voltage Verf may be a voltage of the same level.

Figure 7:
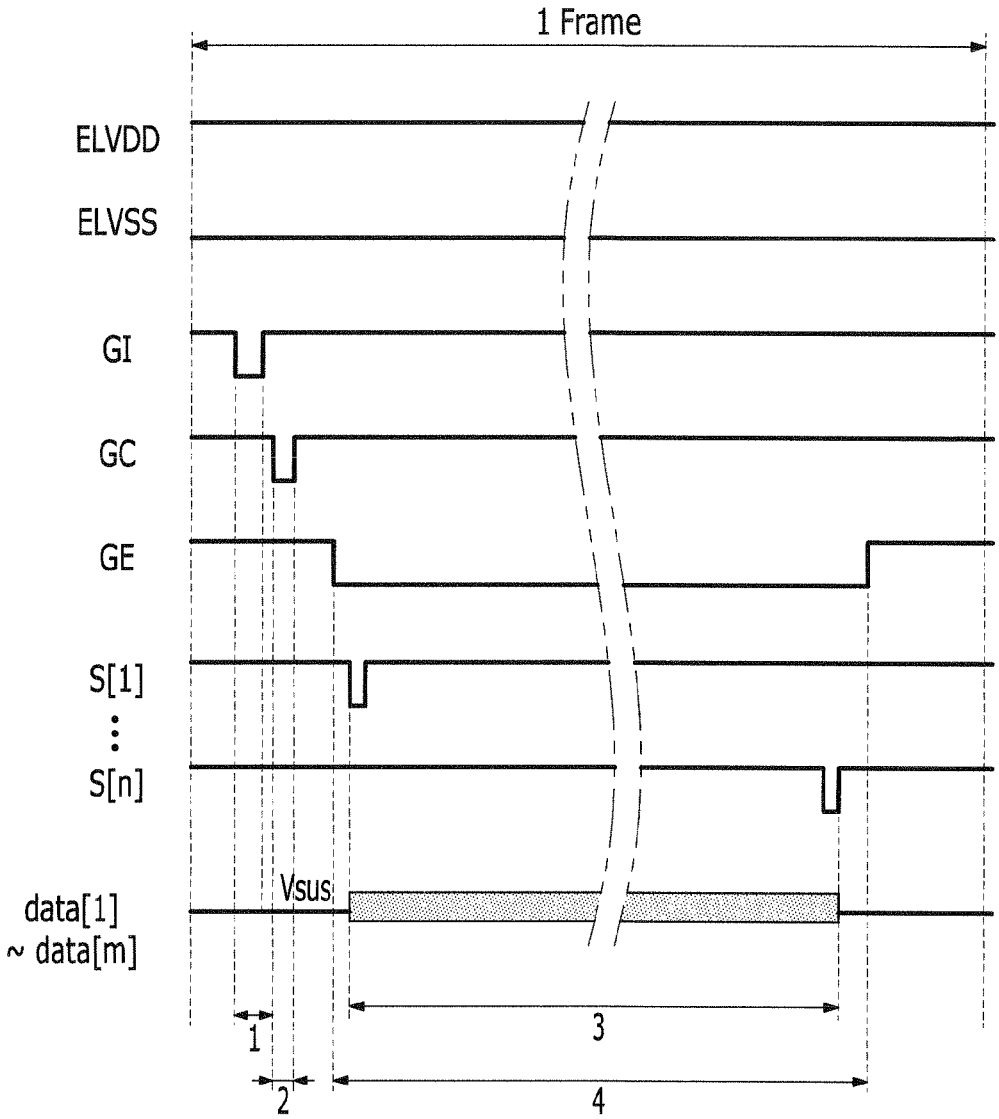
FIG. 7 is a timing diagram of a driving method of a display device according to another exemplary embodiment of the present invention.

FIG. 7 is a timing diagram of a driving method of a display device according to another exemplary embodiment of the present invention.

FIG. 7 is a timing diagram of the driving method of the display device including the pixel 30 according to the second exemplary embodiment of FIG. 6. The initialization transistor TR24 of the pixel 30 according to the second exemplary embodiment is connected to the separately provided initialization voltage Vinit, and therefore the data signals data[1] to data[m] may be maintained with a sustain voltage Vsus without being converted into the initialization voltage Vinit during the initialization period 1.

Since waveforms of an initialization signal GI, a compensation signal GC, a light emission signal GE, scan signals S[1] to S[n], and data signals data[1] to data[m] in each of the initialization period, the compensation period, the scan period 3, and the light emission period 4 are the same as those of FIG. 4, each period will not be further described.

The display device including the pixel 30 according to the second exemplary embodiment may be driven according to the driving method in which the left-eye image and the right-eye image are alternately displayed according to the shutter glasses method described with reference to FIG. 5.

Figure 8:
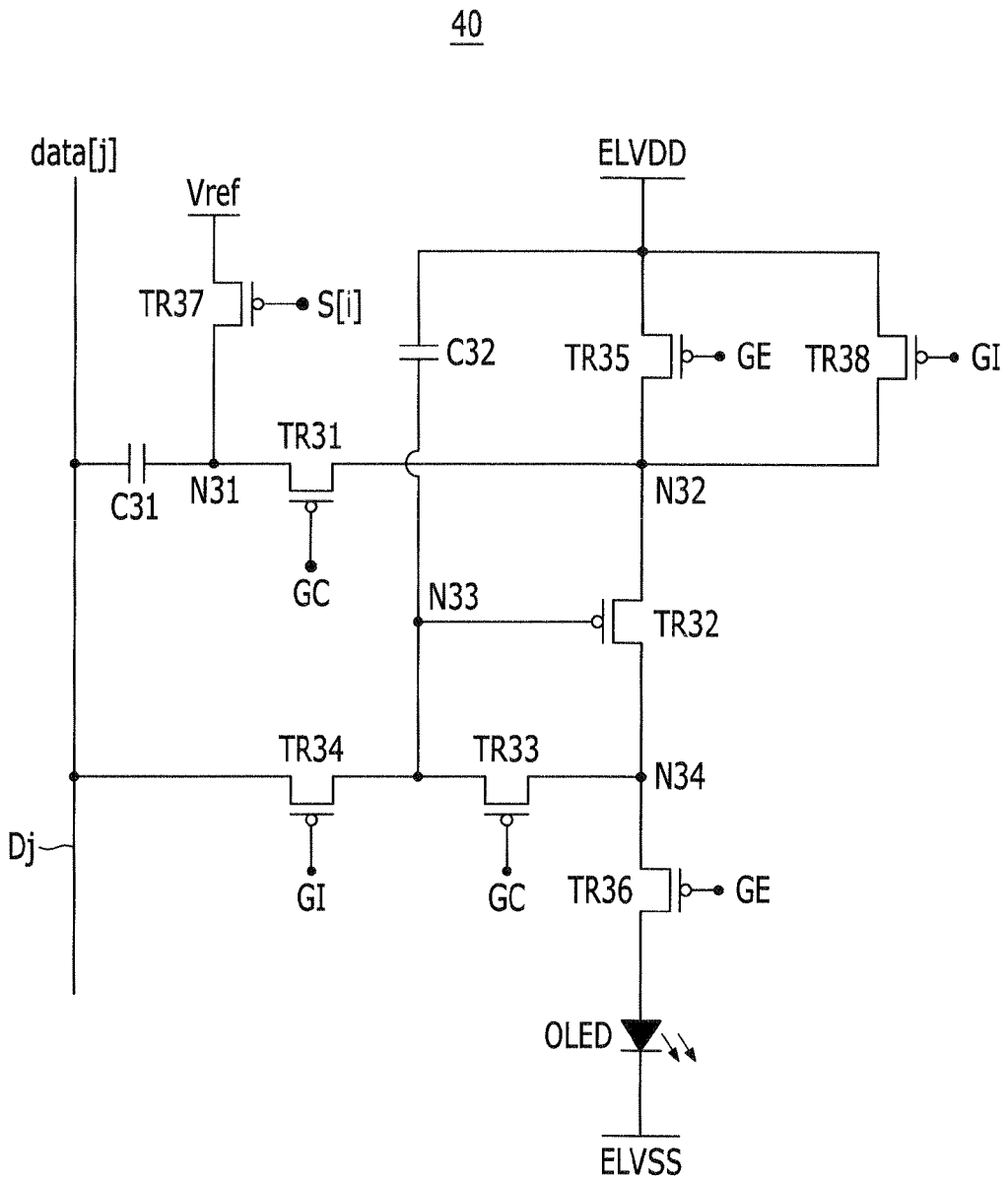
FIG. 8 is a circuit diagram of a pixel according to another exemplary embodiment of the present invention.

FIG. 8 is a circuit diagram of a pixel according to another exemplary embodiment of the present invention.

Referring to FIG. 8, the pixel 40 according to the third exemplary embodiment includes a switching transistor TR31, a driving transistor TR32, a compensation transistor TR33, a first initialization transistor TR34, a first light emitting transistor TR35, a second light emitting transistor TR36, a reference voltage transistor TR37, a second initialization transistor TR38, a first capacitor C31, a second capacitor C32, and an organic light emitting diode (OLED).

Unlike the pixel 20 according to the first exemplary embodiment, the pixel 40 according to the third exemplary embodiment includes the second initialization transistor TR38 including the gate electrode connected to the initialization line, one electrode connected to the first power source voltage ELVDD, and the other electrode connected to the second node N32. The second initialization transistor TR38 is turned on by an initialization signal GI of a gate-on signal and thus transmits the first power source voltage ELVDD to the second node N32. That is, when the initialization signal GI of the gate-on voltage is applied during an initialization period 1, the second initialization transistor TR38 initializes a voltage of the second node N32 to the first power source voltage ELVDD.

A display device including the pixel 40 of the third exemplary embodiment is driven according to the timing diagram of FIG. 4. In addition, the display device including the pixel 40 of the third exemplary embodiment may be driven according to the driving method in that a left-eye image and a right-eye image are alternately displayed according to a shutter glasses method. Therefore, the method for driving the display device including the pixel 40 according to the third exemplary embodiment will not be further described.

Figure 9:
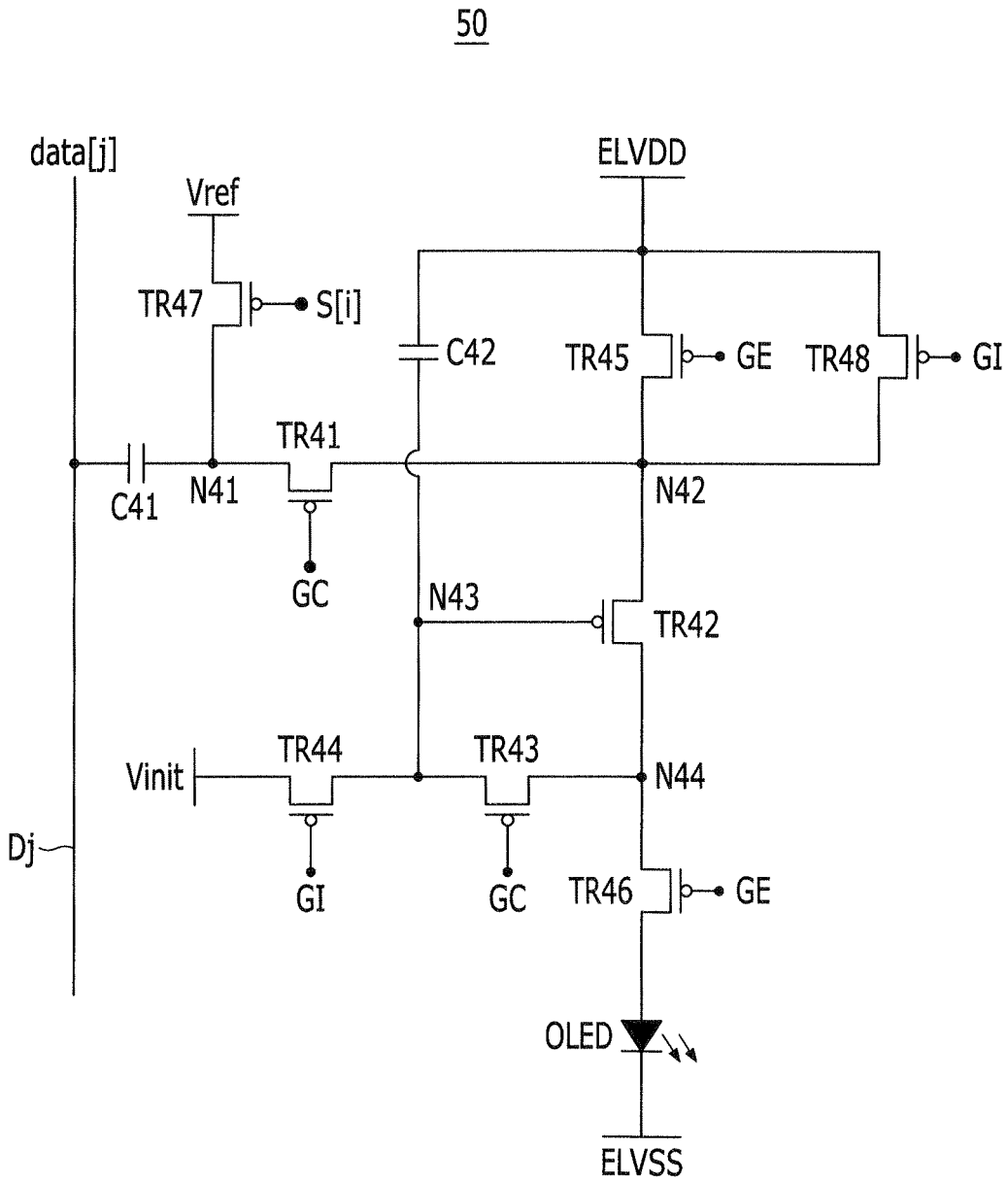
FIG. 9 is a circuit diagram of a pixel according to another exemplary embodiment of the present invention.

FIG. 9 is a circuit diagram of a pixel according to another exemplary embodiment of the present invention.

Referring to FIG. 9, the pixel 50 according to the fourth exemplary embodiment includes a switching transistor TR41, a driving transistor TR42, a compensation transistor TR43, a first initialization transistor TR44, a first light emitting transistor TR45, a second light emitting transistor TR46, a reference voltage transistor TR47, a second initialization transistor TR48, a first capacitor C41, a second capacitor C42, and the organic light emitting diode (OLED).

Unlike the pixel 30 according to the second exemplary embodiment, the pixel 50 according to the fourth exemplary embodiment includes the second initialization transistor TR48 including the gate electrode connected to the initialization line, one electrode connected to the first power source voltage ELVDD, and the other electrode connected to the second node N42. The second initialization transistor TR48 is turned on by an initialization signal GI of a gate-on voltage and transmits a first power source voltage ELVDD to the second node N42. That is, when the initialization signal GI of the gate-on voltage is applied during an initialization period 1, the second initialization transistor TR48 initializes a voltage of the second node N42 into the first power source voltage ELVDD.

The initialization voltage Vinit and the reference voltage Vref may use the same wire. That is, the initialization voltage Vinit and the reference voltage Vref may be a voltage of the same level.

A display device including the pixel 50 according to the fourth exemplary embodiment is driven according to the timing diagram described in FIG. 7. In addition, the display device including the pixel 50 of the fourth exemplary embodiment may be driven according to a driving method in that a left-eye image and a right-eye image are alternately displayed according to the shutter glasses method described in FIG. 5. Therefore, the method for driving the display device including the pixel 50 according to the fourth exemplary embodiment will not be further described.

Figure 10:
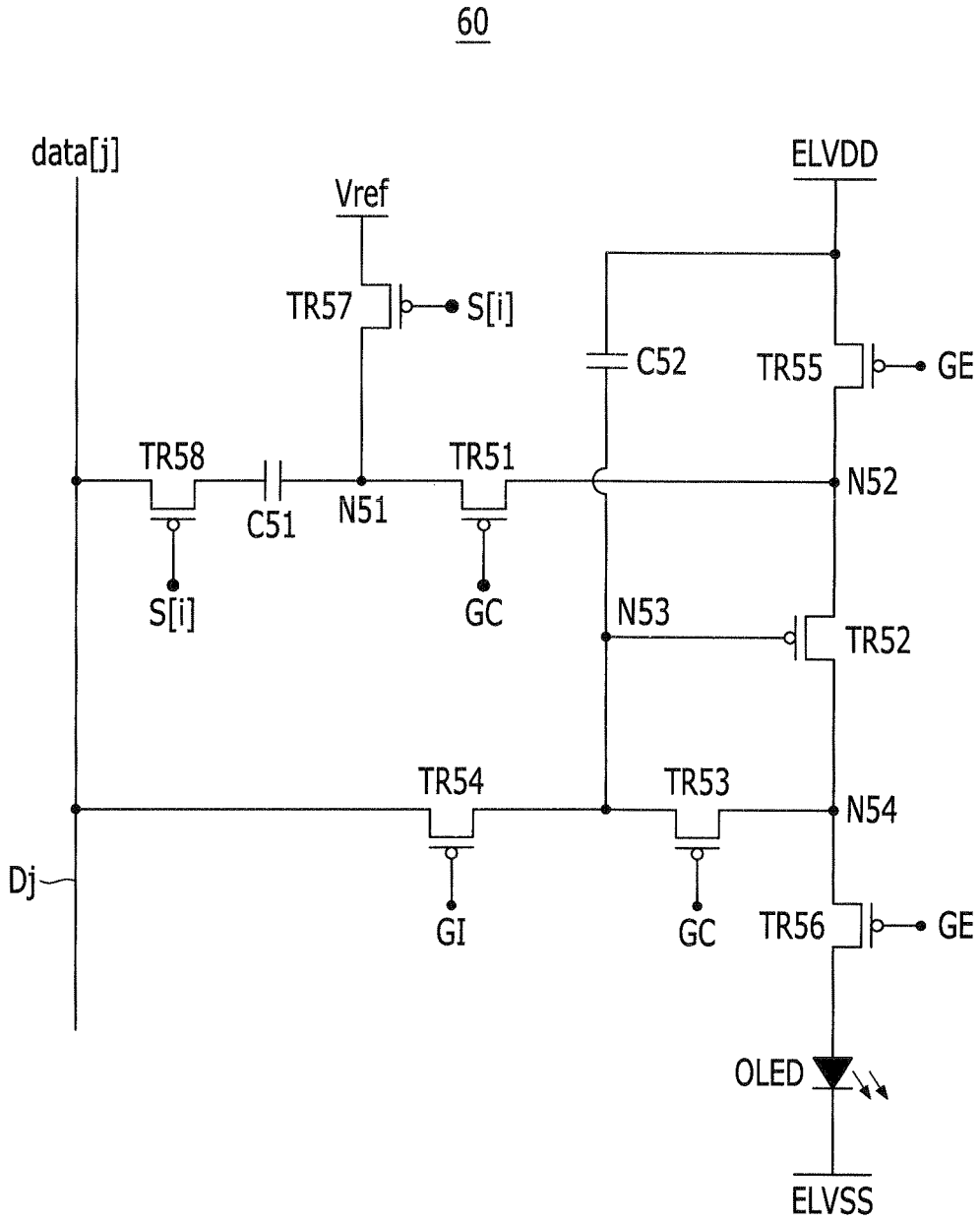
FIG. 10 is a circuit diagram of a pixel according to another exemplary embodiment of the present invention.

FIG. 10 is a circuit diagram of a pixel according to another exemplary embodiment of the present invention.

Referring to FIG. 10, the pixel 60 according to the fifth exemplary embodiment includes a first switching transistor TR51, a driving transistor TR52, a compensation transistor TR53, an initialization transistor TR54, a first light emitting transistor TR55, a second light emitting transistor TR56, a reference voltage transistor TR57, a second switching transistor TR58, a first capacitor C51, a second capacitor C52, and an organic light emitting diode (OLED).

Differently from the pixel 20 according to the first exemplary embodiment, the pixel 60 according to the fifth exemplary embodiment further includes the second switching transistor TR58 connected between the data line Dj and the first capacitor C51. The second switching transistor TR58 includes the gate electrode connected to the scan line, one electrode connected to the data line Dj, and the other electrode connected to one electrode of the first capacitor C51.

The first capacitor C51 includes one electrode connected to the other electrode of the second switching transistor TR58 and the other electrode connected to the first node N51. If the scan signal S[i] of the gate-on voltage is applied during the scan period 3, the second switching transistor TR58 transmits the data voltage data[j] applied to the data line Dj to one electrode of the first capacitor C51.

A display device including the pixel 60 according to the fifth exemplary embodiment is driven according to the timing diagram described in FIG. 4. In addition, the display device including the pixel 60 of the fifth exemplary embodiment may be driven according to a driving method in which a left-eye image and a right-eye image are alternately displayed according to the shutter glasses method described in FIG. 5. Therefore, the method for driving the display device including the pixel 60 according to the fifth exemplary embodiment will not be further described.

The pixel 60 according to the fifth exemplary embodiment further includes the second switching transistor TR58 such that a parasitic capacitor element of the data line may be reduced.

Figure 11:
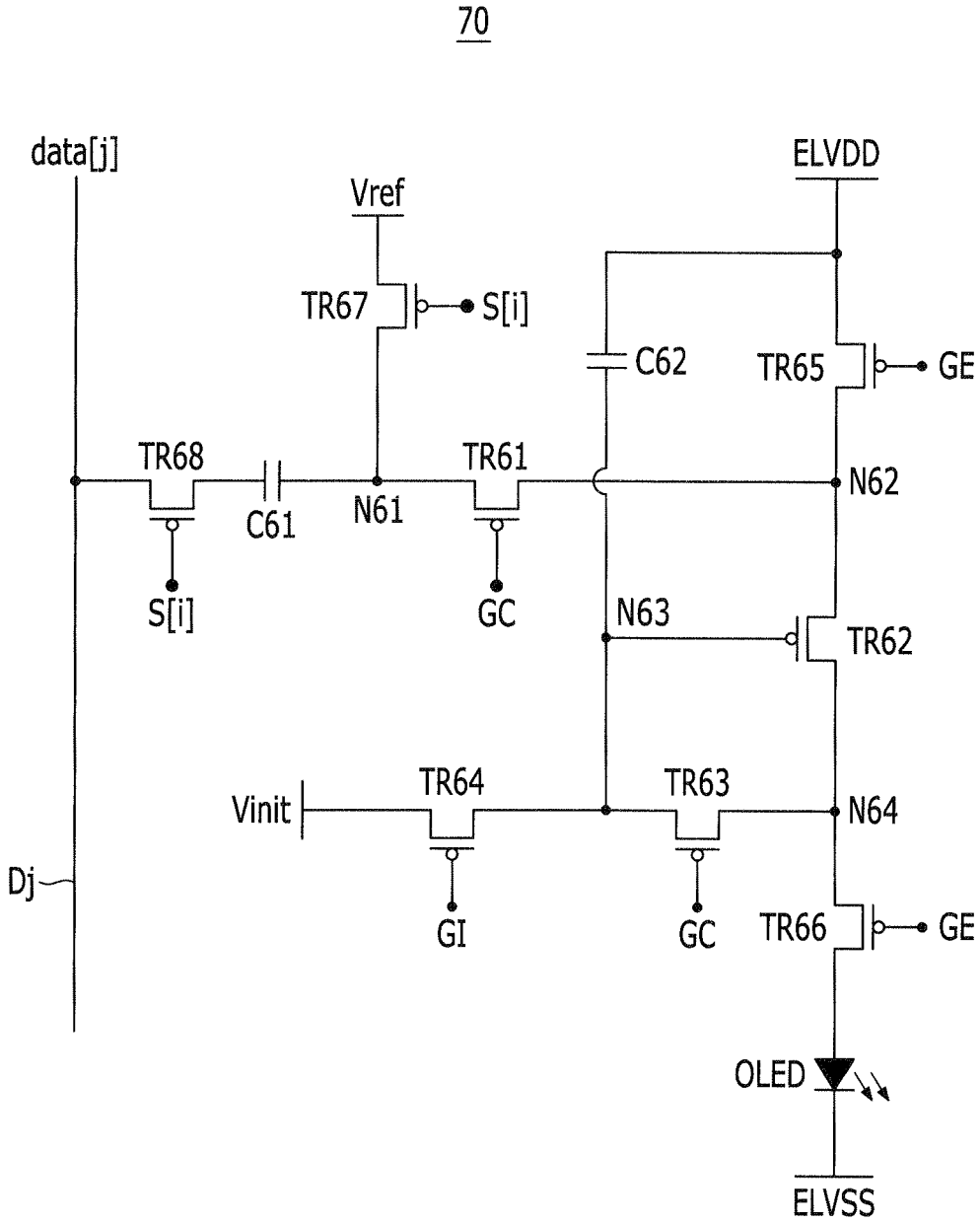
FIG. 11 is a circuit diagram of a pixel according to another exemplary embodiment of the present invention.

FIG. 11 is a circuit diagram of a pixel according to another exemplary embodiment of the present invention.

Referring to FIG. 11, a pixel 70 according to the sixth exemplary embodiment includes a first switching transistor TR61, a driving transistor TR62, a compensation transistor TR63, an initialization transistor TR64, a first light emitting transistor TR65, a second light emitting transistor TR66, a reference voltage transistor TR67, a second switching transistor TR68, a first capacitor C61, a second capacitor C62, and an organic light emitting diode (OLED).

Differently from the pixel 30 according to the second exemplary embodiment, the pixel 70 according to the sixth exemplary embodiment further includes the second switching transistor TR68 connected between the data line Dj and the first capacitor C61. The second switching transistor TR68 includes the gate electrode connected to the scan line, one electrode connected to the data line Dj, and the other electrode connected to one electrode of the first capacitor C61.

The first capacitor C61 includes one electrode connected to the other electrode of the second switching transistor TR68 and the other electrode connected to the first node N61. If the scan signal S[i] of the gate-on voltage is applied during the scan period 3, the second switching transistor TR68 transmit the data voltage data[j] applied to the data line Dj to one electrode of the first capacitor C61.

A display device including the pixel 70 according to the sixth exemplary embodiment is driven according to the timing diagram described in FIG. 7. In addition, the display device including the pixel 70 of the sixth exemplary embodiment may be driven according to a driving method in that a left-eye image and a right-eye image are alternately displayed according to the shutter glasses method described in FIG. 5. Therefore, the method for driving the display device including the pixel 70 according to the sixth exemplary embodiment will not be further described.

The pixel 70 according to the sixth exemplary embodiment further includes the second switching transistor TR68 such that the parasitic capacitor element of the data line may be reduced.

Figure 12:
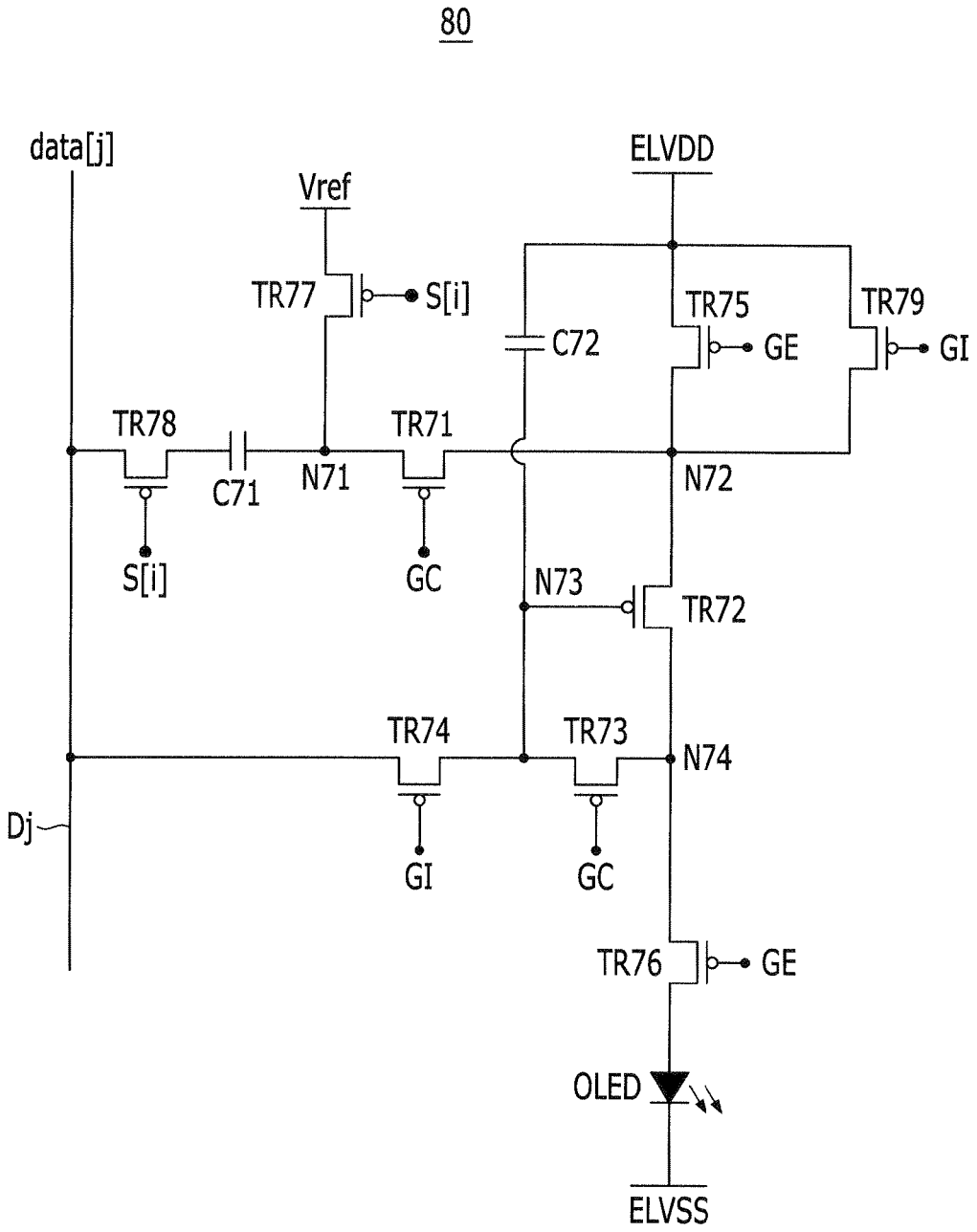
FIG. 12 is a circuit diagram of a pixel according to another exemplary embodiment of the present invention.

FIG. 12 is a circuit diagram of a pixel according to another exemplary embodiment of the present invention.

Referring to FIG. 12, the pixel 80 according to the seventh exemplary embodiment includes a first switching transistor TR71, a driving transistor TR72, a compensation transistor TR73, a first initialization transistor TR74, a first light emitting transistor TR75, a second light emitting transistor TR76, a reference voltage transistor TR77, a second switching transistor TR78, a second initialization transistor TR79, a first capacitor C71, a second capacitor C72, and an organic light emitting diode (OLED).

Differently from the pixel 60 according to the fifth exemplary embodiment, the pixel 80 according to the seventh exemplary embodiment further includes the second initialization transistor TR79 including the gate electrode connected to the initialization line, one electrode connected to the first power source voltage ELVDD, and the other electrode connected to the second node N72. The second initialization transistor TR79 is turned on by the initialization signal GI of the gate-on voltage to transmit the first power source voltage ELVDD to the second node N72. That is, the initialization signal GI of the gate-on voltage is applied during an initialization period 1, and the second initialization transistor TR79 initializes a voltage of the second node N72 into the first power source voltage ELVDD.

A display device including the pixel 80 according to the seventh exemplary embodiment is driven according to the timing diagram described in FIG. 4. In addition, the display device including the pixel 80 of the sixth exemplary embodiment may be driven according to a driving method in that a left-eye image and a right-eye image are alternately displayed according to the shutter glasses method described in FIG. 5. The detailed description for the driving method of the display device including the pixel 80 according to the seventh exemplary embodiment is omitted.

Figure 13:
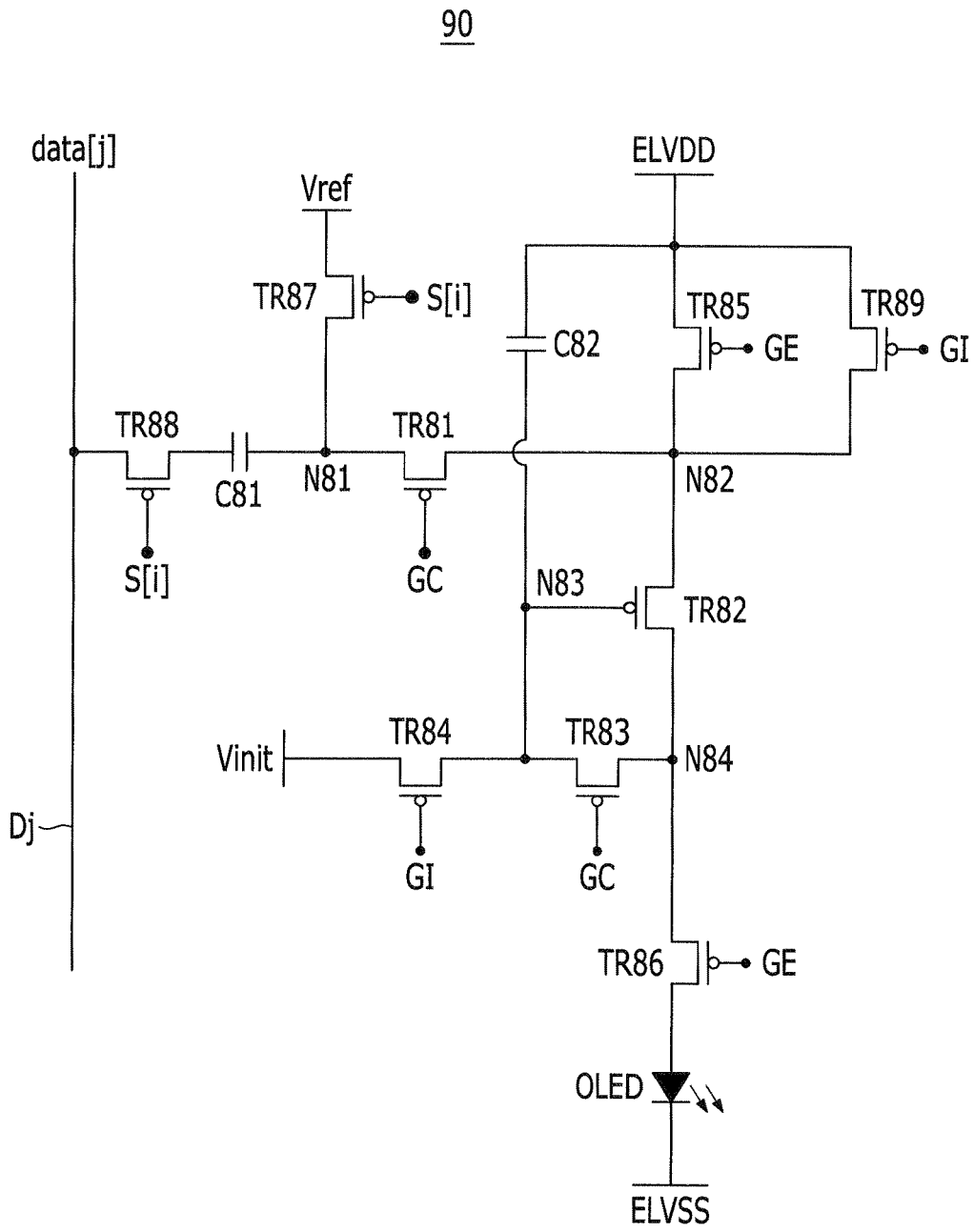
FIG. 13 is a circuit diagram of a pixel according to another exemplary embodiment of the present invention.

FIG. 13 is a circuit diagram of a pixel according to another exemplary embodiment of the present invention.

Referring to FIG. 13, the pixel 90 according to the eighth exemplary embodiment includes a first switching transistor TR81, a driving transistor TR82, a compensation transistor TR83, a first initialization transistor TR84, a first light emitting transistor TR85, a second light emitting transistor TR86, a reference voltage transistor TR87, a second switching transistor TR88, a second initialization transistor TR89, a first capacitor C81, a second capacitor C82, and an organic light emitting diode (OLED).

Differently from the pixel 70 according to the sixth exemplary embodiment, the pixel 90 according to the eighth exemplary embodiment includes the second initialization transistor TR89 including the gate electrode connected to the initialization line, one electrode connected to the first power source voltage ELVDD, and the other electrode connected to the second node N82.

The second initialization transistor TR89 is turned on by an initialization signal GI of a gate-on voltage and transmits a first power source voltage ELVDD to the second node N82. That is, when the initialization signal GI of the gate-on voltage is applied during an initialization period 1, the second initialization transistor TR89 initializes a voltage of the second node N82 into the first power source voltage ELVDD.

A display device including the pixel 90 according to the eighth exemplary embodiment is driven according to the timing diagram described in FIG. 7. In addition, the display device including the pixel 90 of the eighth exemplary embodiment may be driven according to a driving method in that a left-eye image and a right-eye image are alternately displayed according to the shutter glasses method described in FIG. 5. Therefore, the method for driving the display device including the pixel 90 according to the eighth exemplary embodiment will not be further described.

As described above, in the pixel, the voltage Vref-data stored in the first capacitor is applied to the second node with reference to an arbitrary sustain voltage Vsus supplied to the data line, and therefore a voltage having an appropriate range for the first power source voltage LEVDD may be applied to the second node by controlling a level of the sustain voltage Vsus in the compensation period 2 even though an output range of the driving IC of the data driver 300 is fixed. Accordingly, the pixel has advantages in gray expression and luminance improvement.

In addition, since the pixel uses the data line designed to have equivalent resistance without using an additional power source like a reference voltage, non-uniformity in the screen due to the reference voltage line can be prevented, and accordingly, stable and uniform screen display can be achieved.

In addition, since the data programming and the light emission are simultaneously performed in the pixel, sufficient data programming time can be assured so that the pixel can be appropriate for an enlarged and high-resolution display panel and can assure a sufficient aperture ratio by using two capacitors.

The drawings referred to in the above and disclosed in the detailed description of the present invention only illustrate the present invention, and are intended to describe the present invention, not to restrict the meanings or limit the scope of the present invention claimed in the claims. Therefore, those skilled in the art can understand that various modifications and other equivalent exemplary embodiment may be made therefrom. Accordingly, the true technical protection scope of the present invention must be determined by the technical spirit of the accompanying claims.

What is claimed is:

1. A display device comprising:

a plurality of pixels including:

a first capacitor connected between a data line and a first node;

a switching transistor connecting the first node and a second node;

a first light emitting transistor transmitting a first power source voltage to the second node;

a driving transistor having one electrode connected to the second node and controlling a driving current flowing to an organic light emitting diode (OLED); and a reference voltage transistor transmitting a reference voltage to the first node, wherein, when the first power source voltage is applied to the second node through the first light emitting transistor such that a light emitting step in which the organic light emitting diode (OLED) emits light is simultaneously performed in a plurality of pixels, the switching transistor is turned off and the reference voltage transistor is turned on such that the reference voltage is transmitted to the first node, and a data voltage corresponding to a scan signal of a gate-on voltage respectively corresponding to a plurality of pixels is stored to the first capacitor.

2. The display device of claim 1, wherein the reference voltage transistor is turned on by the scan signal of the gate-on voltage such that the reference voltage is transmitted to the first node.

3. The display device of claim 2, further comprising a second switching transistor that is turned on by the scan signal of the gate-on voltage to transmit the data voltage to the first capacitor.

4. The display device of claim 2, wherein the plurality of pixels further include a compensation transistor connecting the gate electrode and the other electrode of the driving transistor.

5. The display device of claim 4, wherein the plurality of pixels further include an initialization transistor connected to the gate electrode of the driving transistor.

6. The display device of claim 5, wherein the plurality of pixels further include a second light emitting transistor connected to the other electrode of the driving transistor and an anode of the organic light emitting diode (OLED).

7. The display device of claim 6, wherein the initialization transistor includes a gate electrode applied with an initialization signal, one electrode connected to the data line, and the other electrode connected to the gate electrode of the driving transistor.

8. The display device of claim 7, wherein when the initialization signal of the gate-on voltage is applied to the gate electrode of the initialization transistor, the initialization voltage is applied to the data line.

9. The display device of claim 8, wherein the plurality of pixels further include a second initialization transistor including a gate electrode applied with the initialization signal, one electrode connected to the first power source voltage, and the other electrode connected to the second node.

10. The display device of claim 6, wherein the initialization transistor includes a gate electrode applied with the initialization signal, one electrode applied with the initialization voltage, and the other electrode connected to the gate electrode of the driving transistor.

11. The display device of claim 10, further comprising a second initialization transistor including a gate electrode applied with the initialization signal, one electrode connected to the first power source voltage, and the other electrode connected to the second node.

12. The display device of claim 6, wherein when a compensation control signal of the gate-on voltage is applied to the gate electrode of the compensation transistor, the data line is applied with a sustain voltage and the compensation control signal of the gate-on voltage is applied to the gate electrode of the switching transistor gate electrode such that the data voltage that was stored to the first capacitor is transmitted to the second node with reference to the sustain voltage.

13. The display device of claim 12, wherein the data voltage that was stored to the first capacitor is the data voltage that is applied in a frame previous to a current frame.

14. The display device of claim 13, wherein the plurality of pixels further include a second capacitor connected between the gate electrode of the driving transistor and the first power source voltage to store a voltage reflecting a data voltage of a previous frame.

15. A method of driving a display device respectively including a plurality of pixels including a first capacitor connected between a data line and a first node, a switching transistor connecting the first node and a second node, a first light emitting transistor transmitting a first power source voltage to the second node, a driving transistor having one electrode connected to the second node and controlling a driving current flowing to the organic light emitting diode (OLED), and a reference voltage transistor transmitting a reference voltage to the first node, the method comprising:

a scan step in which the data voltage transmitted through the data line is stored to the first capacitor when the switching transistor is turned off and a scan signal of a gate-on voltage is transmitted to the reference voltage transistor; and a light emitting step in which the first power source voltage is applied to the second node through the first light emitting transistor such that an organic light emitting diode (OLED) emits light, such that each light emitting step of the plurality of pixels is a simultaneous period, and the scan step and the light emitting step are temporally overlapped with each other.

16. The method of claim 15, wherein the scan step includes a step in which the scan signal of the gate-on voltage is applied to a gate electrode of a second switching transistor connecting the data line and the first capacitor to transmit the data voltage to the first capacitor.

17. The method of claim 15, wherein the light emitting step includes:

a step in which the first light emitting transistor transmitting the first power source voltage to one electrode of the driving transistor is turned on; and a step in which the second light emitting transistor connected between the other electrode of the driving transistor and an anode of the organic light emitting diode (OLED) is turned on.

18. The method of claim 15, further comprising an initialization step in which an initialization signal of the gate-on voltage is applied to the gate electrode of the initialization transistor connected to the gate electrode of the driving transistor to transmit the initialization voltage to the gate electrode of the driving transistor.

19. The method of claim 18, wherein the initialization step includes a step in which the initialization signal of the gate-on voltage is applied to the gate electrode of the initialization transistor, wherein the initialization transistor includes one electrode connected to the data line and the other electrode connected to the gate electrode of the driving transistor.

20. The method of claim 19, wherein the initialization step includes a step in which the second initialization transistor including a gate electrode applied with the initialization signal, one electrode connected to the first power source voltage, and the other electrode connected to the second node is turned on.

21. The method of claim 18, wherein the initialization step includes a step in which an initialization signal of a gate-on voltage is applied to the gate electrode of the initialization transistor, wherein the initialization transistor includes one electrode applied with the initialization voltage and the other electrode connected to the gate electrode of the driving transistor.

22. The method of claim 21, wherein the initialization step includes a step in which the second initialization transistor including a gate electrode applied with the initialization signal, one electrode connected to the first power source voltage, and the other electrode connected to the second node is turned on.

23. The method of claim 15, further comprising a compensation step in which a compensation control signal of the gate-on voltage is applied to the gate electrode of the compensation transistor connecting the gate electrode and the other electrode of the driving transistor to compensate a threshold voltage of the driving transistor.

24. The method of claim 23, wherein the compensation step includes a step in which a sustain voltage is applied to the data line and the compensation control signal of the gate-on voltage is applied to the gate electrode of the switching transistor to transmit the data voltage stored to the first capacitor to the second node with reference of the sustain voltage when the compensation control signal of the gate-on voltage is applied to the gate electrode of the compensation transistor.

25. The method of claim 24, wherein the data voltage stored to the first capacitor is a data voltage applied in a frame previous to a current frame.

26. The method of claim 25, wherein the compensation step includes a step in which the compensation transistor is turned on, and a voltage reflecting the threshold voltage of the driving transistor and a data voltage of a previous frame is stored to a second capacitor connected to the gate electrode of the driving transistor and the first power source voltage.

27. A pixel comprising:

a first capacitor including one electrode applied with a data voltage and the other electrode connected to a first node;

a reference voltage transistor including a gate electrode applied with a scan signal, one electrode connected to a reference voltage, and the other electrode connected to the first node;

a first switching transistor including a gate electrode applied with a compensation control signal, one electrode connected to the first node, and the other electrode connected to a second node;

a first light emitting transistor including a gate electrode applied with a light emitting signal, one electrode connected to a first power source voltage, and the other electrode connected to the second node;

a driving transistor including a gate electrode connected to a third node, one electrode connected to the second node, and the other electrode connected to a fourth node;

a compensation transistor including a gate electrode applied with the compensation control signal, one electrode connected to the third node, and the other electrode connected to the fourth node; and a second capacitor including one electrode connected to the third node and the other electrode connected to the first power source voltage.

28. The pixel of claim 27, further comprising a second switching transistor including a gate electrode applied with the scan signal, one electrode connected to the data line, and the other electrode connected to one electrode of the first capacitor.

29. The pixel of claim 27, further comprising a second light emitting transistor including a gate electrode applied with the light emitting signal, one electrode connected to the fourth node, and the other electrode connected to the anode of an organic light emitting diode (OLED).

30. The pixel of claim 29, further comprising an initialization transistor transmitting an initialization voltage to the third node according to the initialization signal.

31. The pixel of claim 30, wherein the initialization transistor includes a gate electrode applied with the initialization signal, one electrode connected to the data line, and the other electrode connected to the third node.

32. The pixel of claim 31, further comprising a second initialization transistor including a gate electrode applied with the initialization signal, one electrode connected to the first power source voltage, and the other electrode connected to the second node.

33. The pixel of claim 30, wherein the initialization transistor includes a gate electrode applied with the initialization signal, one electrode connected to the initialization voltage, and the other electrode connected to the third node.

34. The pixel of claim 33, further comprising a second initialization transistor including a gate electrode applied with the initialization signal, one electrode connected to the first power source voltage, and the other electrode connected to the second node.

* * * * *